US005613885A

United States Patent [19]

Plate et al.

[11] Patent Number: 5,613,885

[45] Date of Patent: Mar. 25, 1997

[54] ELECTRICAL CONNECTOR DEVICE

[75] Inventors: Herbert Plate, Lüdenscheid; Georg Schröder, Drolshagen/Bleche, both of Germany

[73] Assignee: Leopold Kostal GmbH & Co. KG, Ludenscheid, Germany

[21] Appl. No.: 548,339

[22] Filed: Nov. 1, 1995

[30] Foreign Application Priority Data

Nov. 2, 1994 [DE] Germany ..... 44 39 105.6

[51] Int. Cl.[6] ..... H01R 15/10

[52] U.S. Cl. ..... 439/843; 439/851

[58] Field of Search ..... 439/839, 842, 439/843, 851, 856

[56] References Cited

U.S. PATENT DOCUMENTS 3,123,429 4/1961 Anderson et al. ..... 439/843
3,894,785 7/1975 Hubner et al. ..... 439/851
5,188,545 2/1993 Hass et al. ..... 439/851
5,433,629 7/1995 Yagi et al. ..... 439/843

*Primary Examiner*—David L. Pirlot
*Assistant Examiner*—Brian J. Biggi
*Attorney, Agent, or Firm*—Brooks & Kushman P.C.

[57] ABSTRACT

An electrical connector with a connector part having a rectangular cross-section and a casing part. The casing part has a main body which comprises a contact region formed with a rectangular cross-section like a quiver-like case which receives and holds a contact. In order to create an electrical connector device which can be produced simply and cost-effectively and in which at the same time good transmission of current is ensured, the contact consists of a contact plate which is bent in a U shape about the middle region extending transverse to its longitudinal extension. Two contact arms are formed extending substantially spaced apart and parallel to each other, of which the free ends are connected to the mouth region of the contact region in order to fix the contact on the main body both in a form locking manner and in a materially bonded manner.

22 Claims, 5 Drawing Sheets

ELECTRICAL CONNECTOR DEVICE

TECHNICAL FIELD

The present invention relates to an electrical connector device.

BACKGROUND ART

Electrical connector devices are provided by means of their casing part and their connector part to form a releasable electrical connection, for example, between an electric cable and a further electric cable or an electric cable and an electric unit.

An electrical connector device is known from DE 38 17 803 C2. This electrical connector device consists of a rectangular connector part and a casing part. The casing part consists of a main body produced by stamping and bending sheet metal. The contact region has a rectangular cross-section and allows the connector part to receive, like a quiver, a separate contact means. The separate contact means comprises a plurality of longitudinally parallel disposed contact cross-pieces for contact with the connector part and is also formed with a rectangular cross-section by being bent a number of times. During assembly the retainer-like contact means is pushed into the quiver-like contact region of the main body until a funnel flange integrally formed thereon bears against the free front end of the main body and a locking projection integrally formed on the main body comes to lie in a locking opening provided in the contact means.

DE 39 06 625 C1 discloses an electrical casing part in which the contact means consists of a contact plate which is bent in a U shape about the middle region extending transversely to its longitudinal extension, so that two contact arms are formed which are disposed opposite each other and extend substantially parallel to each other. However, this contact means is allocated to a solidly formed main body and is fixed by its middle region connecting the two contact arms on the main body in a form locking and non-positive manner.

SUMMARY OF THE INVENTION

It is an object of the present invention to create an electrical connector device which can be produced simply and in a particularly cost-effective manner and in which at the same time a good transfer of current is ensured between the casing part consisting of the contact means and main body, and the connector part.

In accordance with the invention this object is achieved in an electrical connector device with a rectangular connector part and a casing part. The casing part comprises a main body with a rectangular contact region for connection to the connector part to receive a separate contact means in a quiver-like manner. An attachment region adjoins the contact region of the main body for connection to an electric cable. The contact means comprises several longitudinally parallel contact cross-pieces positioned inwards in places to form contact points. A U-shaped contact plate is formed about a middle region and extends transverse to its longitudinal extension. Two contact arms extend from the middle region substantially spaced apart and parallel to each other to define at least two contact cross-pieces. Free ends of the arms are connected to a mouth of the contact region in both a form locking and materially bonded manner to affix the contact means on the main body.

It is advantageous in such a formation that the free end regions of the contact arms are connected in a form locking manner as well as a materially bonded manner to the mouth region of the main body so that the contact means can expand during contact with the connector part in the connecting direction and the mating forces arising during contact are comparatively low. This is particularly desirable especially in high polar electrical connector device arrangements.

Further advantageous embodiments of the subject matter in accordance with the invention are given in the dependent claims. The invention is described in more detail with the aid of three embodiments illustrated in the drawing.

BEST MODE FOR CARRYING OUT THE INVENTION

Figure 1:
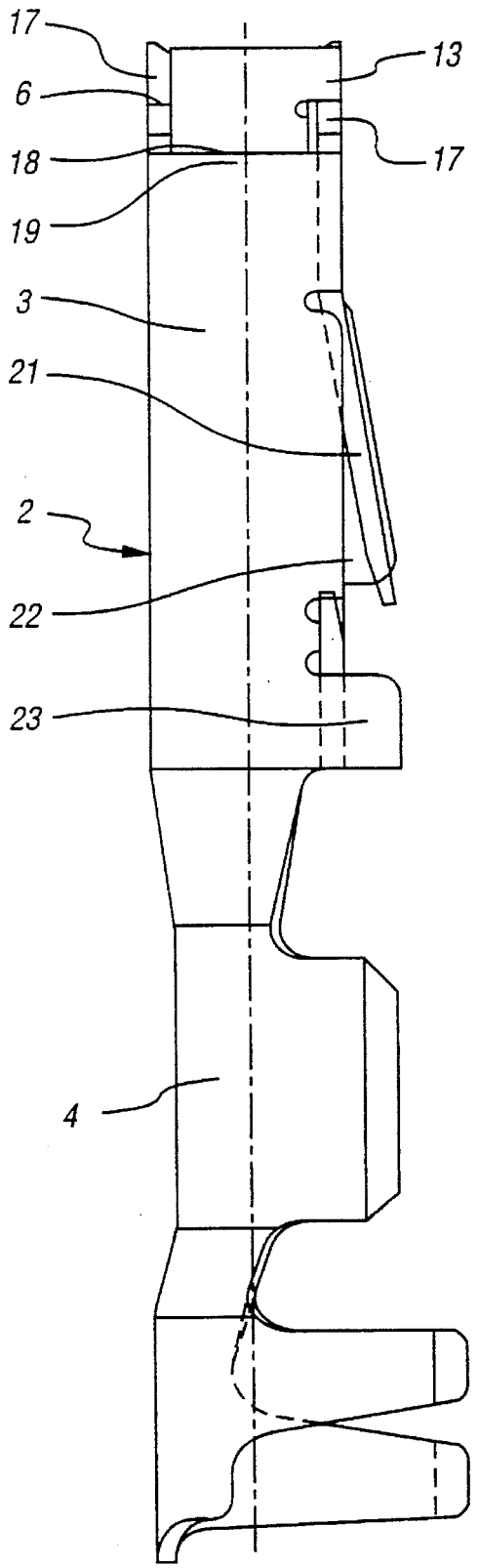
FIG. 1 shows a lateral view of a casing part in cross-section.

Similar details of the subject matter in accordance with the invention are provided with the same reference numbers.

In the drawings only the electrically conductive metal components of an electrical connector device arrangement are illustrated. In most cases, however, a housing, not described in more detail and produced, for example, of synthetic material, also appertains to an electrical connector device arrangement. A housing part is thus allocated to the casing part or parts and a housing part is allocated to the connector part or parts.

As shown in the drawings such an electrical connector device consists of a connector part 1 formed with a rectangular cross-section and of a casing part. The casing part in turn consists of a main body 2 formed by stamping and bending sheet metal and comprising a contact region 3 provided for connection to the connector part 1, and an attachment region 4 provided for attachment to an electric cable. The contact region 3 is formed as a quiver with a rectangular cross-section, by which a separate contact means 6 provided with several contact cross-pieces 5 is received and held. During assembly the contact means 6 is pushed in the connection direction to be received and held in the quiver-like contact region 3 of the main body 2.

As is particularly evident from FIGS. 7 to 12 the contact means 6 consists of an originally flat contact plate. In order to produce the contact means 6 the sheet metal blank is bent in a U-shape around the middle region 7 extending transverse to its longitudinal extension so that two contact arms 8 extend substantially spaced apart and parallel to each other. In the middle region of one of the two contact arms 8 a recess 9 is provided extending parallel to the long side thereof. Thus each of the two contact arms 8 comprises two contact cross-pieces 5. The two contact cross-pieces 5 of the two contact arms 8 are disposed oppositely and are positioned inwardly as a flange neck in order to form defined contact positions.

Figure 10:
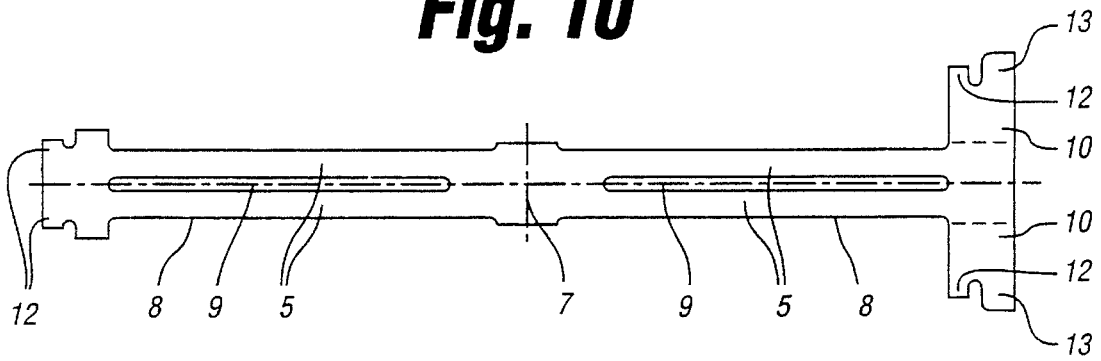
FIG. 10 illustrates the first contact means in accordance with FIG. 7 as a flat sheet metal blank.
Figure 11:
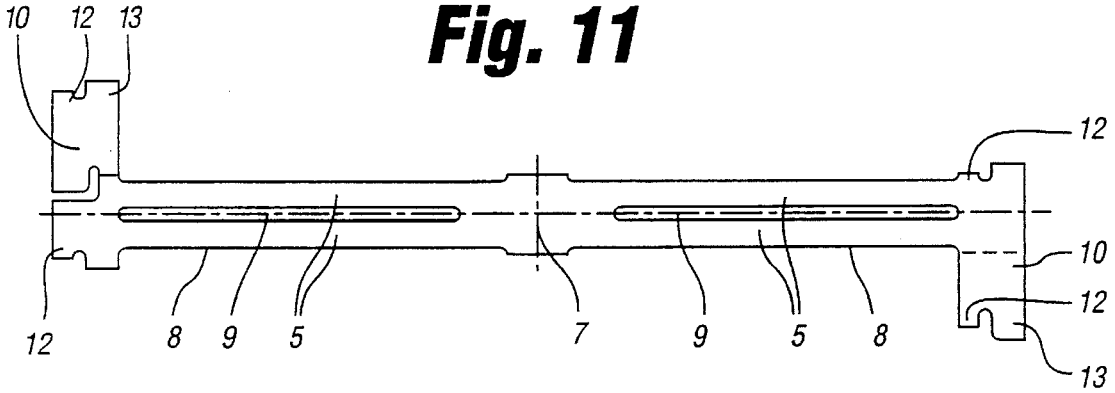
FIG. 11 illustrates a second contact means as a flat sheet metal blank.
Figure 12:
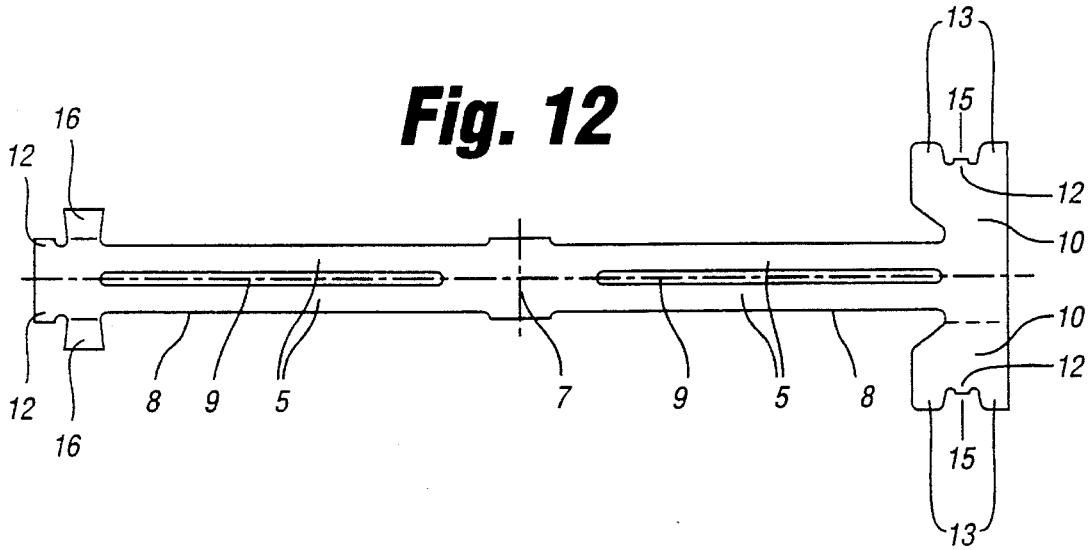
FIG. 12 illustrates a third contact means as a flat sheet metal blank.

As particularly evident from the alternative embodiments depicted in FIGS. 10 to 12, the free end regions of the two contact arms 8 are formed differently. In order to produce a contact means 6 of which the free end region 11 in the complete state is formed as a rectangular frame, at least one of the two contact arms 8 comprises at least one cross-piece-like widened portion 10. As particularly evident from FIGS. 10 and 12, on each of the two long sides of one of the two contact arms 8 a cross-piece-like widened portion 10 is integrally formed so that the free end of this contact arm 8 comprises a T-shaped contour. After bending round the two cross-piece-like widened portions 10, an end region of this contact arm 8 is produced which is U-shaped in cross-section. As the other contact arm 8 is finally received between the two cross-piece-like widened portions 10 during the deforming process of the contact plate, a contact means 6 is produced of which the free end region 11 is formed as a rectangular frame.

As is particularly evident from FIG. 11, a cross-piece-like widened portion 10 is integrally formed on each of the two long sides of the contact arms 8 in a diagonally opposite manner. After bending round the cross-piece-like widened portions 10, free ends for the two contact arms 8 are thus produced which each comprise an L-shaped contour in cross-section. During the deformation process of the contact plate, the cross-piece-like widened portion 10 of one of the contact arms 8 comes to lie at the free end of the other contact arm 8. The cross-piece-like widened portion 10 of the other contact arm 8 comes to lie at the free end of one of the contact arms 8. A contact means 6 is thus produced of which the free end region 11 is formed as a rectangular frame.

After deformation of the contact plate, in order that a defined spacing is provided between the two contact arms 8 of the contact means 6, stop projections 12, which come into position against each other, are integrally formed on the cross-piece-like widened portions 10 and on the free ends of the contact arms 8 (see FIGS. 7 to 12). With the aid of the stop projections 12, the two contact arms 8are not only held at a defined distance but at the same time a more stable end region 11 for the contact means 6 is produced, formed as a rectangular frame.

As also evident in particular from FIGS. 7 to 11, a fixing tab 13 is also integrally formed on each of the cross-piece-like widened portions 10 of the contact arms 8. The fixing tabs 13 extend perpendicular to the main surface of the two contact arms 8, wherein they protrude from one of the outer walls of the free end region 11 of the contact means 6. Thus a receiving pocket 14 with a U-shaped cross-section is produced by means of which the contact means 6 is brought into connection with the contact region 3 of the main body 2 in a form locking and materially bonded manner.

As is particularly evident from FIG. 12 a cross-piece-like widened portion 10 is integrally formed on each of the two long sides of one of the contact arms so that a T-shaped free end is formed. On each of the two cross-piece-like widened portions 10 two fixing tabs 13 are integrally formed between which in each case a stop projection 12 is provided. Since the two fixing tabs 13 are formed longer than the stop projections 12 a holding recess 15 is formed into which, after the deformation process of the contact plate, a holding wing 16 integrally formed on the other contact arm 8 engages in a form locking manner. Thus an extremely stable free end region 11 of the contact means 6 is produced, which is formed as a rectangular frame. In such a formation an almost play-free coordination of the two contact arms 8 of the contact means 6 is produced.

As is particularly evident from FIGS. 1 to 6, the main body 2 consists of a contact region 3 and an attachment region 4. The contact region 3 is formed as a rectangular quiver at the mouth region of which two fixing prongs 17 are integrally formed. The two fixing prongs 17 are provided for fixing the contact means 6 to be mounted, in a form locking and materially bonded manner. Each one of the three described contact means variations illustrated in the FIGS. 7 to 12 can be received by the contact region 3 of the main body 2. For reasons of simplicity only the fittings of the main body 2 with one contact means variation are illustrated in FIGS. 1 to 5. The contact means variation used is the contact means 6 illustrated in more detail in FIGS. 7 to 10.

For the purposes of assembly the contact means 6 is pushed, in the connecting direction of the connector part 1, into the contact region 3 of the main body 2, which is formed in a quiver-like manner and is rectangular in cross-section. Thus one of the two fixing prongs 17 integrally formed at the mouth region on the contact region 3 comes to lie in the U-shaped receiving pocket 14 formed by the two fixing tabs 13. The other of the two fixing prongs 17 lies against the side wall, opposite the receiving pocket 14, of the free end region 11 of the contact means 6, formed as a rectangular frame. The contact means 6 is pushed during assembly into the contact region 3 until the free end region 11 comes to lie with its front walls 18 allocated to the attachment region 4 in position against the mouth walls 19 of the contact region 3. The contact means 6 is thus received in a form locking manner by the contact region 3 of the main body 2. In order to fix the contact means 6 definitively on the main body 2 and in order to ensure a particularly good transfer of current between the casing part and the connector part 1, the contact means 6 is also welded to the contact region 3. In order to produce the materially-bonded connection the mutually allocated stamped edges of the fixing prong 17 disposed in the receiving pocket 14 and of the fixing tabs 13 forming the receiving pocket 14 are connected to each other by welding points 20 (see in particular FIGS. 3 to 5).

In order to produce primary locking which becomes effective in cooperation with the housing part (not illustrated), a resiliently elastic locking arm 21 protrudes outwardly as one piece from the contact region 3. A protective tab 22 also protrudes from the contact region 3 approximately parallel to the locking arm 21. The protective tab 22 serves as an interlocking protection so that the casing parts to not inadvertently lock together, for example, during transport. In order to produce secondary locking which becomes effective in cooperation with the housing part (not illustrated), a locking projection 23 is integrally formed on the end of the contact region 3 allocated to the attachment region 4 (see in particular FIGS. 1, 2 and 6). The locking projection cooperates, for example, with a locking bar to be pushed into the housing.

Figure 2:
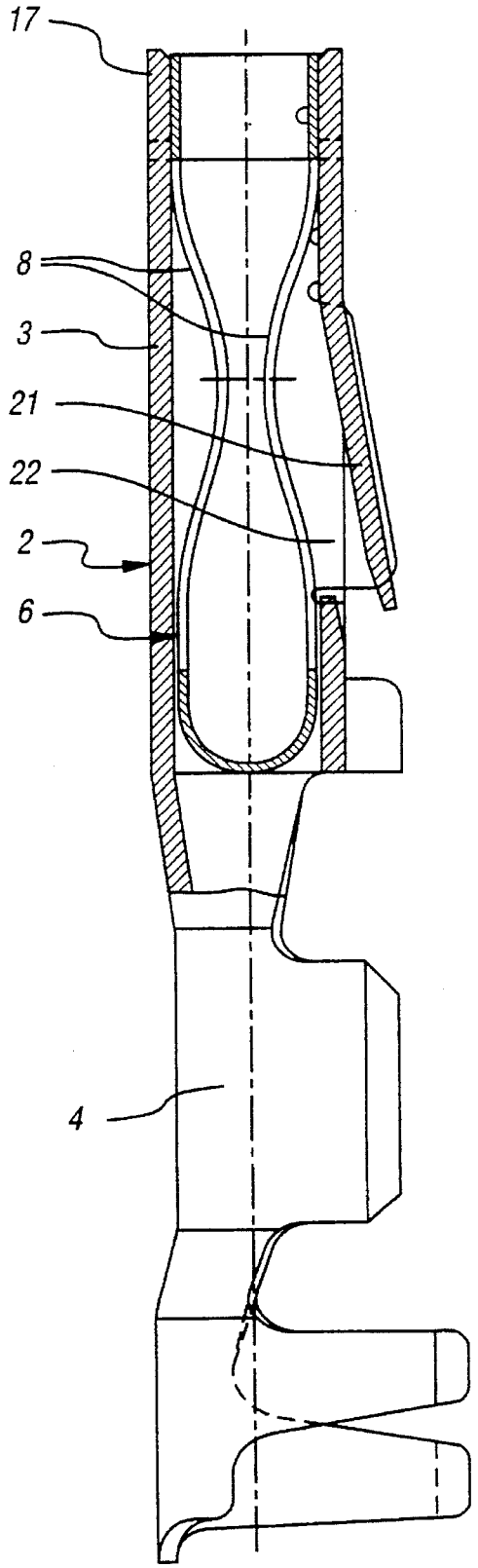
FIG. 2 illustrates a lateral view of the casing part in accordance with FIG. 1.
Figure 3:
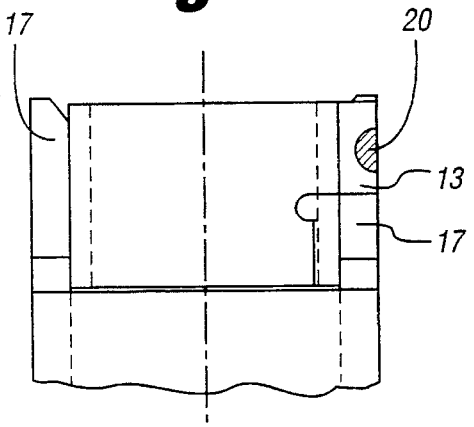
FIG. 3 illustrates a lateral view of the free end region of the casing part in accordance with FIG. 2 on an enlarged scale.
Figure 4:
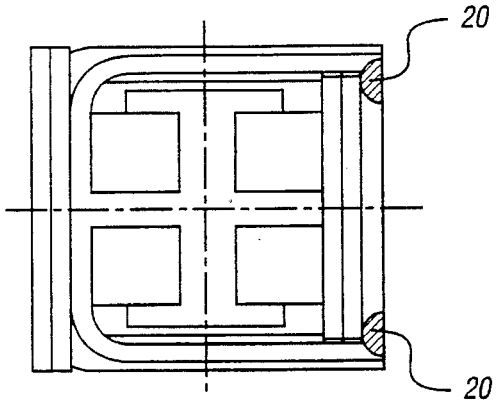
FIG. 4 illustrates a front view of the free end region of the casing part in accordance with FIG. 2 on an enlarged scale.
Figure 5:
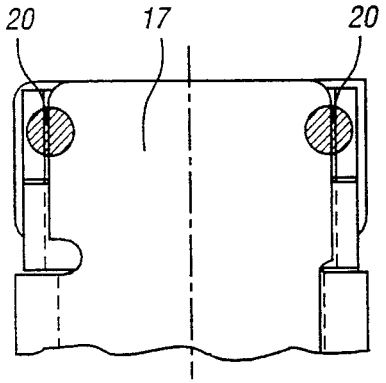
FIG. 5 illustrates a plan view of the free end region of the casing part in accordance with FIG. 2 on an enlarged scale.
Figure 6:
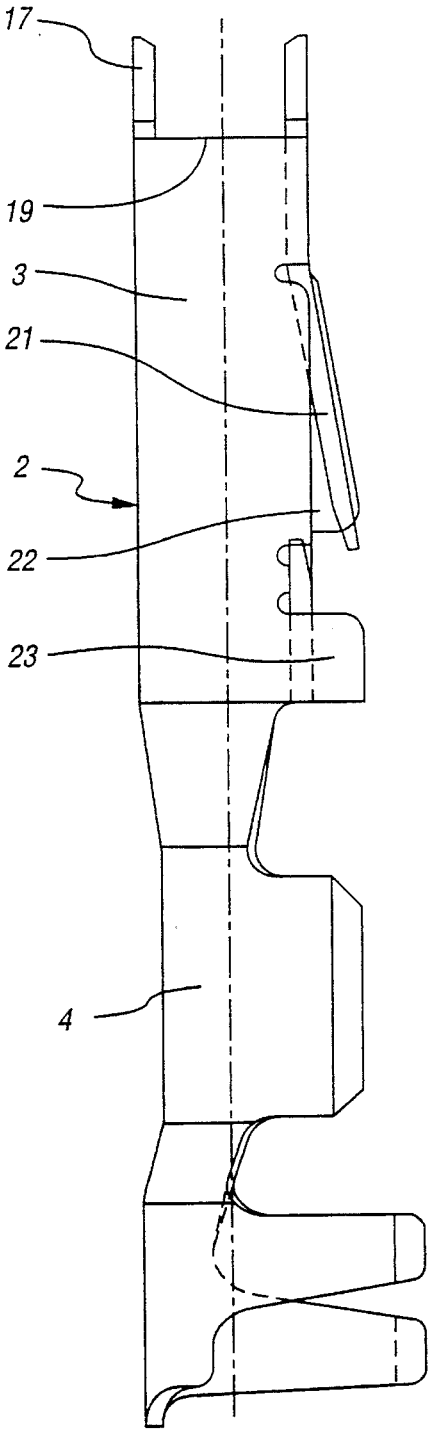
FIG. 6 illustrates a lateral view of the casing part in accordance with FIG. 2 without contact means.
Figure 8:
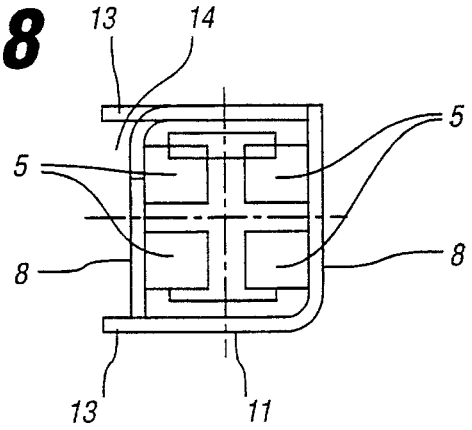
FIG. 8 illustrates a front view of the first contact means in accordance with FIG. 7.
Figure 7:
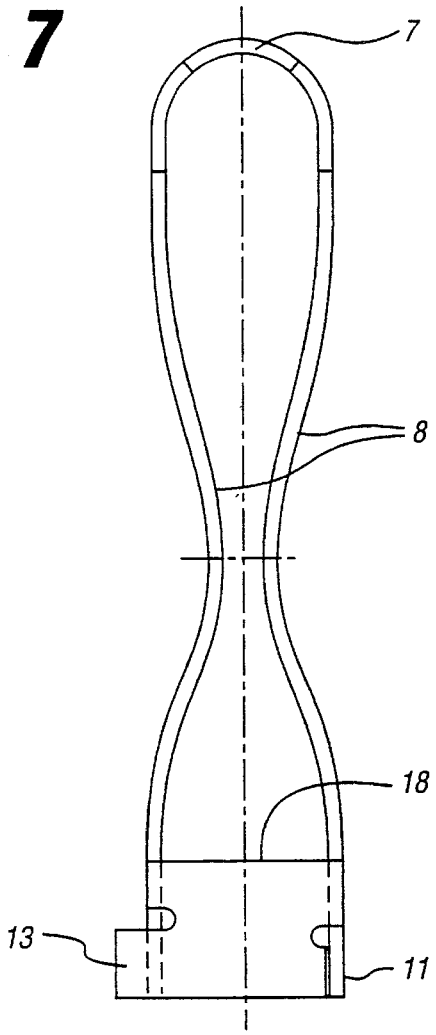
FIG. 7 illustrates a lateral view of a first contact means.
Figure 9:
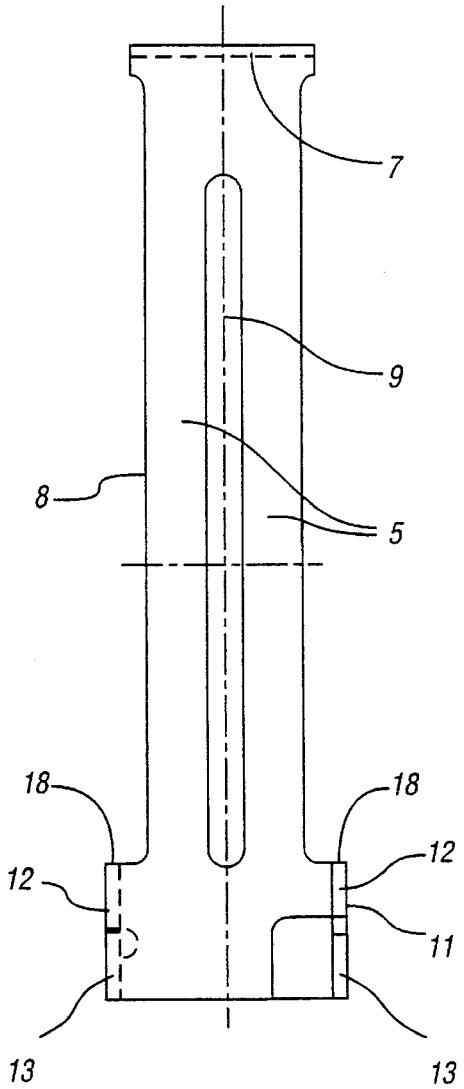
FIG. 9 illustrates a plan view of the first contact means in accordance with FIG. 7.

Furthermore, it is particularly evident from FIGS. 1, 2 and 6 that attachment region 4 of the main body 2 provided for connection with an electric cable is formed as a so-called crimp zone. Of course, the attachment region can also be formed in another way so that, for example, a so-called cut-clamping zone is produced.

Figure 13:
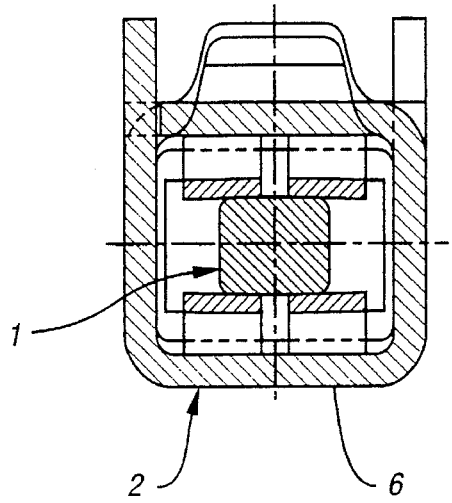
FIG. 13 illustrates a cross-section through a casing part with an inserted connector part formed as a square post.
Figure 14:
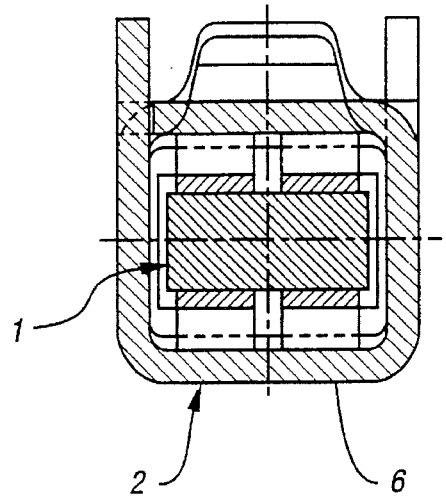
FIG. 14 illustrates a cross-section though a casing part with an inserted first connector part formed as a flat blade.
Figure 15:
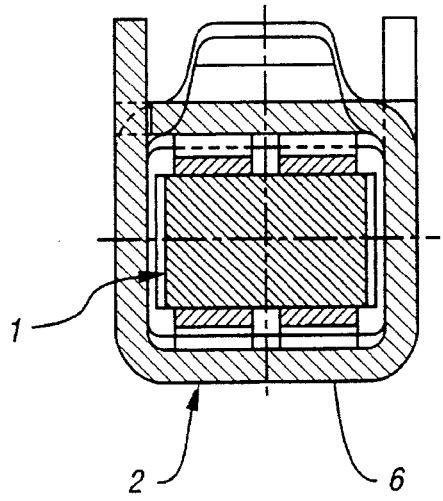
FIG. 15 illustrates a cross-section through a casing part with an inserted second connector part formed as a flat blade.

The contact region 3 is arranged with its contact means 6, as is particularly evident from FIGS. 13 to 15, in such a way that connector parts 1 which are different in dimensions and contours can be contacted. The casing part is thus suited by virtue of its contact region 3 to contact rectangular connector parts 1, which can be formed in width from the narrowest contactable connector part 1 to a maximum of double this width and in height from the shortest contactable connector part 1 up to a maximum of greater by one third. Thus it is insignificant whether the connector parts 1 to be contacted are formed as posts comprising a square cross-section (FIG. 13) or as flat blades (FIGS. 14, 15) comprising a rectangular cross-section.

While the best mode for carrying out the invention has been described in detail, those familiar with the art to which this invention relates will recognize various alternative designs and embodiments for practicing the invention as defined by the following claims.

What is claimed is:

1. An electrical connector device with a rectangular connector part and a casing part, the casing part comprising:

a main body (2) with a rectangular contact region (3) for connection to the connector part (1) and to receive a separate contact means (6) in a quiver-like manner; and an attachment region (4) adjoining the contact region (3) of the main body (2) for connection to an electric cable;

the contact means (6) comprising:

a U-shaped contact plate formed about a middle region (7) extending transverse to its longitudinal extension;

two contact arms (8) extending from the middle region (7) that extend substantially spaced apart and parallel to each other to define at least two contact cross-pieces (5);

free ends of the arms being connected to a mouth of the contact region (3) to affix the contact means (6) on the main body (2).

2. An electrical connector part according to claim 1 wherein the attachment region (4) of the main body (2) adjoining the contact region (3) is provided with a crimp-zone to receive an electric cable.

3. An electrical connector part according to claim 1, wherein the attachment region (4) of the main body (2) adjoining the contact region (3) is provided with a cut-clamping zone to receive an electric cable.

4. An electrical connector part according to claim 1, wherein the connector part (1) is formed as a post with a square cross-section.

5. An electrical connector part according to claim 1, wherein the connector part (1) is formed as a flat blade.

6. An electrical connector device according to claim 1, wherein on the free end of at least one of the two contact arms (8) at least one cross-piece-like widened portion (10) is integrally formed, and wherein the cross-piece-like widened portion (10) is deformed in such a way that the free end region (11) of the contact means (6) forms a rectangular frame.

7. An electrical connector device according to claim 6, wherein a cross-piece-like widened portion (10) is integrally formed on both long sides of one of the two contact arms (8) so that the free end of one of the contact arms (8) has a contour with a U-shaped cross-section after bending round the two cross-piece-like widened portions (10), wherein the other contact arm (8) of the contact means (6) is received between the two cross-piece-like widened portions (10) to define a free end region (11) formed as a rectangular frame.

8. An electrical connector device according to claim 6, wherein a cross-piece-like widened portion (10) is integrally formed in a diagonally opposite manner on one of the two long sides of the two contact arms (8) so that the free ends of the two contact arms (8) each comprise an L-shaped contour in cross-section after bending round the two cross-piece-like widened portions (10), wherein in order to form a contact means (6) with a free end region (11) formed as a rectangular frame, the cross-piece-like widened portion (10) of one of the contact arms (8) comes to lie at the other contact arm (8) and the cross-piece-like widened portion (10) of the other contact arm (8) at one of the contact arms (8).

9. An electrical connector device according to claim 6, wherein proximate the free ends, stop projections (12) are integrally formed on the two contact arms (8), which, after bending the contact plate about its middle region (7) come into position against each other so that it is ensured that a defined distance between the contact cross-pieces (5) of the two contact arms (8) is obtained.

10. An electrical connector part according to claim 6, wherein proximate the free ends, fixing tabs (13) are integrally formed on at least one of the two contact arms (8).

11. An electrical connector part according to claim 10, wherein the fixing tabs (13) are integrally formed on the cross-piece-like widened portions (10) of the contact arms (8), wherein the fixing tabs (13) extend perpendicular to the main surfaces of the two contact arms (8).

12. An electrical connector part according to claim 11, wherein the fixing tabs (13) protrude from an outer wall of the free end region (11) of the contact means (6), formed as a frame, so that on the contact means (6) a receiving pocket (14) with a U-shaped cross-section is provided for regions of the main body (2).

13. An electrical connector part according to claim 1, wherein at the mouth region of the contact region (3) formed in a quiver-like manner, two fixing prongs (17) are integrally formed, between which, after assembly of the contact means (6) on the main body (2) the free end region (11) thereof formed as a frame is received in a form locking manner so that two outer walls of the mouth region of the contact region (3) are formed by the fixing prongs (17) and two outer walls are formed by the free end region (11) of the contact means (6).

14. An electrical connector part according to claim 13, wherein one of the two fixing prongs (17) of the contact region (3) comes to lie in a form locking manner in a U-shaped receiving pocket (14) of the contact means (6) and wherein mutually allocated stamped edges of the fixing prongs (17) and of two fixing tabs (13) are connected to each other in a materially bonded manner by a welding point (20).

15. An electrical connector part according to claim 1, wherein in one of four long walls of the mouth region of the contact region (3) two fixing slits extending in a connection direction are provided, and during assembly of the contact means (6) receive fixing tabs (13) integrally formed thereon, in a form locking manner so that outer walls of the mouth region of the contact region (3) are formed almost completely by outer walls of the contact region (3).

16. An electrical connector part according to claim 15, wherein a side wall provided with two fixing slits comes to lie in the U-shaped receiving pocket (14) of the contact means (6) and wherein mutually allocated stamped edges of the two fixing slits and of the two fixing tabs (13) passing through the fixing slits are connected to each other in a materially bonded manner by a welding point (20).

17. An electrical connector part according to claim 1, wherein in the middle region of each of the two contact arms (8) of the contact means (6), a recess (9) extending parallel to the long sides of the contact arms (8) is provided so that each of the two contact arms (8) comprises two contact cross-pieces (5).

18. An electrical connector part according to claim 17, wherein the contact cross-pieces (5) of the two contact arms (8) are disposed opposite each other and are positioned inwardly like a flange neck in order to form contact points.

19. An electrical connector part according to claim 1, wherein a resiliently elastic locking arm (21) protrudes outwardly as one piece from the contact region (3) of the main body (2), formed in a quiver-like manner.

20. An electrical connector part according to claim 19, wherein a protective tab (22) preventing inadvertent locking of the locking arm (21) is integrally formed on the contact region (3) and extends parallel to the locking arm (21).

21. An electrical connector part according to claim 20, wherein a locking projection (23) facing the attachment region (4) is integrally formed on the contact region (3) of the main body (2).

22. An electrical connector part according to claim 21, wherein a parting line extending through the contact region (3) of the main body (2) is bridged in a materially bonded manner by at least one welding point in order to protect against divergence in the contact region (3).

* * * * *